US010541459B2

(12) United States Patent
Grede et al.

(10) Patent No.: US 10,541,459 B2
(45) Date of Patent: Jan. 21, 2020

(54) POWER COMBINER HAVING A SYMMETRICALLY ARRANGED COOLING BODY AND POWER COMBINER ARRANGEMENT

(71) Applicant: TRUMPF Huettinger GmbH + Co. KG, Freiburg (DE)

(72) Inventors: Andre Grede, Freiburg (DE); Alexander Alt, Freiburg (DE); Daniel Gruner, Muellheim (DE); Anton Labanc, Ehrenkirchen (DE)

(73) Assignee: TRUMPF Huettinger GmbH + Co. KG, Freiburg (DE)

( * ) Notice: Subject to any disclaimer, the term of this patent is extended or adjusted under 35 U.S.C. 154(b) by 29 days.

(21) Appl. No.: 15/855,129

(22) Filed: Dec. 27, 2017

(65) Prior Publication Data

US 2018/0123212 A1 May 3, 2018

Related U.S. Application Data

(63) Continuation of application No. PCT/EP2016/065380, filed on Jun. 30, 2016.

(30) Foreign Application Priority Data

Jun. 30, 2015 (DE) ..... 10 2015 212 233

(51) Int. Cl.
*H01P 5/16* (2006.01)
*H01P 1/18* (2006.01)

(52) U.S. Cl.
CPC . *H01P 5/16* (2013.01); *H01P 1/18* (2013.01)

(58) Field of Classification Search
CPC ... H01P 5/19; H01P 1/18; H01P 5/187; H03H 7/48
See application file for complete search history.

(56) References Cited

U.S. PATENT DOCUMENTS 3,506,932 A 4/1970 Beurrier
4,091,343 A 5/1978 Knox et al.
(Continued)

FOREIGN PATENT DOCUMENTS

DE 10342611 4/2005
DE 202010016850 4/2011
(Continued)

OTHER PUBLICATIONS

International Search report and Written Opinion in International application No. PCT/EP2016/065380, dated Oct. 12, 2016, 25 pages (with English translation).

*Primary Examiner* — Robert J Pascal
*Assistant Examiner* — Kimberly E Glenn
(74) *Attorney, Agent, or Firm* — Fish & Richardson P.C.

(57) ABSTRACT

A power combiner for coupling, splitting, or coupling and splitting high-frequency signals, the power combiner has a first input for a first high-frequency signal, a second input for a second high-frequency signal, an output, an equalizing connection, a first electrical conductor arranged between the first input and the output, wherein the first electrical conductor has a first total surface shaped primarily as a first planar surface electrode, a second electrical conductor arranged between the second input and the equalizing connection, wherein the second electrical conductor has a second total surface shaped primarily as a second planar surface electrode, and wherein the second electrical conductor is capacitively and inductively coupled to the first electrical conductor; and a cooling body, wherein more than 70% of the first total surface of the first electrical conductor is a same distance from the cooling body as the second total surface of the second electrical conductor.

18 Claims, 2 Drawing Sheets

(56) References Cited

U.S. PATENT DOCUMENTS

| | | | | |
|---|---|---|---|---|
| 5,369,379 | A * | 11/1994 | Fujiki | H01P 5/185 333/116 |
| 5,521,563 | A | 5/1996 | Mazzochette | |
| 7,151,422 | B2 | 12/2006 | Pivit et al. | |
| 8,044,749 | B1 | 10/2011 | Witas et al. | |
| 8,133,347 | B2 | 3/2012 | Gluck et al. | |
| 2001/0028283 | A1 | 10/2001 | Sasaki et al. | |
| 2002/0175775 | A1* | 11/2002 | Lillo | H01P 5/185 333/1 |
| 2003/0137363 | A1 | 7/2003 | Bawell et al. | |
| 2006/0208827 | A1 | 9/2006 | Pivit et al. | |
| 2007/0120621 | A1* | 5/2007 | Kirkeby | H01P 5/12 333/116 |
| 2014/0085019 | A1 | 3/2014 | Mei et al. | |

FOREIGN PATENT DOCUMENTS

| | | |
|---|---|---|
| DE | 102011087807 | 6/2013 |
| EP | 1699107 | 9/2006 |
| WO | WO 2017/001598 | 1/2017 |

* cited by examiner

POWER COMBINER HAVING A SYMMETRICALLY ARRANGED COOLING BODY AND POWER COMBINER ARRANGEMENT

CROSS REFERENCE TO RELATED APPLICATIONS

This application is a continuation of and claims priority under 35 U.S.C. § 120 from PCT Application No. PCT/EP2016/065380 filed on Jun. 30, 2016, which claims priority from German Application No. DE 10 2015 212 233.6, filed on Jun. 30, 2015. The entire contents of each of these priority applications are incorporated herein by reference.

TECHNICAL FIELD

The disclosure relates to a power combiner for coupling and/or splitting high-frequency signals.

BACKGROUND

It is known to use power combiners comprising electrical conductors to bring together multiple high-frequency signal sources and/or to split a high-frequency signal. A power combiner that includes a second electrical conductor that is spaced apart from a first electrical conductor is known from EP 1 699 107 A1, in which the first electrical conductor is capacitively and inductively coupled to the second electrical conductor. Both the first electrical conductor and the second electrical conductor can include multiple windings to increase the inductive coupling between the conductors, in accordance with EP 1 699 107 A1.

Other power combiners are known, for example, from U.S. Pat. No. 8,044,749 B1, DE 103 42 611 A1, and US 2014/0085019 A1.

SUMMARY

A power combiner has to be sufficiently cooled. Effective cooling can be achieved by a cooling body. As described herein, the cooling body can be positioned close to the electrical conductors of the power combiner to allow for good heat dissipation.

Owing to the proximity of the electrical conductors to the cooling body, however, a parasitic capacitance occurs between the cooling body and the electrical conductors; the closer the electrical conductors are to the cooling body, the more effective the cooling, but also the greater the parasitic capacitance. As a result of the parasitic capacitance, the behavior of the power combiner is altered in an adverse manner.

To overcome this problem, the present disclosure features power combiners and a power combiner arrangements that have both effective cooling by a cooling body and minimally adverse electrical effects of the cooling body on the power characteristics of the power combiner. The power combiners for coupling and/or splitting high-frequency signals having a frequency of more than 1 MHz to produce an output power of more than 100 W, include a) a first input for a first high-frequency signal; b) a second input for a second high-frequency signal; c) an output; d) an equalizing connection; e) a first electrical conductor between the first input and the output, wherein the first electrical conductor is primarily in the form of a planar surface electrode; f) a second electrical conductor arranged between the second input and the equalizing connection, wherein the second electrical conductor is primarily in the form of a planar surface electrode and the second electrical conductor is capacitively and inductively coupled to the first electrical conductor; and g) a cooling body, where more than 70% of the total surface of the first electrical conductor is the same distance from the cooling body as the total surface of the second electrical conductor.

The power combiners have a symmetrical arrangement of the electrical conductors relative to the cooling body. As a result, parasitic capacitances are distributed symmetrically over the two conductors, and therefore there is a significantly more advantageous effect on the power characteristics of the power combiners described herein.

In various embodiments, more than 75%, more than 80%, or more than 90% of the total surface of the first electrical conductor is the same distance from the cooling body as the total surface of the second electrical conductor.

In some embodiments, the power combiners as described herein can be in the form of a 90° hybrid coupler. The power combiners can be operated in the form of a power splitter. In some embodiments, the power combiners can be designed as power splitters for outputting power of more than 100 W.

In other embodiments, the power combiners can be designed for coupling high-frequency signals of between 1 MHz and 200 MHz. In some embodiments, the power combiners can be designed for outputting power of more than 2 kW.

In some embodiments, the power combiners are designed to produce a transmission loss of less than 0.5 dB (e.g., less than 0.3 dB, less than 0.1 dB), in operation at a frequency of ±10% of the fundamental frequency.

A load, e.g., in the form of a plasma system, can be connected to the output of the power combiner. The equalizing connection can preferably be connected to ground, in particular by a terminator. The terminator can have a reference impedance of 25 Ω or 50 Ω. The reference impedance is the impedance for which the power combiner is configured at its inputs and outputs.

The cooling body can be in the form of a cooling plate. The cooling plate can include fluid flow ducts, e.g., water ducts.

To effectively inductively couple the first conductor to the second conductor, the first electrical conductor and the second electrical conductor should each have a number of windings n>1. The number of windings of the first electrical conductor and the second electrical conductor can be n>2, e.g., n=3, or n>3. An inner winding of the first electrical conductor and/or of the second electrical conductor can include a path section that does not extend in parallel with an outer winding, to produce phase equalization between the inner winding and the outer winding.

The capacitive and inductive coupling of the power combiners can be further improved and the arrangements made more symmetrical if more than 60% of the total surface of the first electrical conductor faces the total surface of the second electrical conductor so as to be congruent, e.g., coplanar. In different embodiments, more than 70%, more than 80%, or more than 90% of the total surface of the first electrical conductor is opposite the total surface of the second electrical conductor and congruent, e.g., coplanar.

In certain embodiments, the reference impedance can be reduced to values of less than 50 Ω. The inductivity of the first and second electrical conductor is then reduced, and therefore installation can take place within a smaller surface area. In some instances, the reference impedance is 2 5Ω at a frequency of more than 1 MHz at the first and the second input. For example, the reference impedance is in each case less than 50 Ω, in particular in each case less than 25 Ω, at a frequency of more than 3 MHz, 10 MHz, 40 MHz, 100 MHz or 200 MHz at the first and the second input.

In some embodiments, the first electrical conductor can include a first primary conductor portion and a second primary conductor portion and the second electrical conductor can include a first secondary conductor portion and a second secondary conductor portion, more than 70% of the second secondary conductor portion extends so as to be offset from the first primary conductor portion in a coplanar and congruent manner. More than 70% of the second primary conductor portion extends so as to be coplanar and congruent with the first secondary conductor portion.

The second secondary conductor portion thus extends below the first primary conductor portion at least in part and the second secondary conductor portion extends below the first secondary conductor portion at least in part. For example, in some embodiments, more than 80%, or more than 90% of the second secondary conductor portion extends so as to be offset from the first primary conductor portion in a coplanar and congruent manner. More than 80%, or more than 90% of the second primary conductor portion extends so as to be coplanar and congruent with the first secondary conductor portion.

In certain embodiments, more than 70%, more than 80%, or more than 90% of the first primary conductor portion extends in parallel with the first secondary conductor portion, and more than 70%, more than 80%, more than 90% of the second secondary conductor portion extends in parallel with the second primary conductor portion.

In some embodiments, the cooling body may be arranged between the first secondary conductor portion and the second primary conductor portion. This results in a particularly symmetrical design of the power combiner.

In certain embodiments, the power combiners can include an air gap between the first and second electrical conductors. In some embodiments, however, the power combiners can include a dielectric, e.g., an electrically insulating substrate, between the planar surface electrode of the first electrical conductor and the planar surface electrode of the second electrical conductor. As a result, the power combiner can be manufactured in a particularly compact and cost-effective manner. Furthermore, the dielectric, e.g., the electrically insulating substrate, protects against spark-overs between the electrical conductors.

In some embodiments, the planar surface electrode of the first electrical conductor and the planar surface electrode of the second electrical conductor may be arranged directly on a dielectric, e.g., an electrically insulating substrate. For example, the planar surface electrode of the first electrical conductor can be arranged on a first dielectric, e.g., an electrically insulating substrate, of the power combiner in part or entirely, and the planar surface electrode of the second electrical conductor can be arranged on a second dielectric, e.g., an electrically insulating substrate, of the power combiner in part or entirely.

In another configuration, a first primary conductor portion of the first surface electrode is arranged on the first main face of the first dielectric, e.g., an insulating substrate, and a second primary conductor portion of the first surface electrode is arranged on the first main face of the second dielectric, e.g., an insulating substrate, wherein a first secondary conductor portion of the second surface electrode is arranged on the second main face of the first dielectric, e.g. an electrically insulating substrate, and a second secondary conductor portion of the second surface electrode is arranged on the second main face of the second dielectric, e.g. an insulating substrate.

Alternatively or additionally, the first planar surface electrode and the second planar surface electrode can include portions that alternately extend on a first planar main face of a dielectric, e.g., an electrically insulating substrate, and on a second planar main face of a dielectric, e.g., an electrically insulating substrate, that is opposite the first planar main face. The first main face and second main face can be main faces of a single dielectric, e.g. an electrically insulating substrate.

The power combiners can include a multi-layered circuit board, the multi-layered circuit board comprising the planar surface electrode of the first electrical conductor and the planar surface electrode of the second electrical conductor.

In some embodiments, at least one dielectric, e.g., an electrically insulating substrate, of the multi-layered circuit board includes circuit board material made of epoxy resin fabric. Another layer of the multi-layered circuit board can include polytetrafluoroethylene or a polyimide-containing conductor-path support material. As a result, the electrical breakdown resistance is significantly increased, while having low manufacturing costs at the same time.

In various embodiments, the multi-layered circuit boards can have lateral dimensions in the main plane of the multi-layered circuit board, in which the surface electrodes of the first and second conductors extend, of less than λ/100, or less than λ/200, where λ refers to a frequency (f) at the first and second input of more than 1 MHz (e.g., more than 3 MHz, 10 MHz, 40 MHz, 100 MHz or 200 MHz).

In some embodiments, the power combiners are designed as a 90° hybrids. If the 90° hybrid is used for coupling high-frequency signals, the signals at the two inputs are coupled together at one output when the signals at the inputs are phase-shifted by 90°. If the 90° hybrid is used for splitting high-frequency signals, a signal applied at one input is split evenly at two outputs, the two split signals being phase-shifted by 90°.

In some embodiments, the first and the second electrical conductors can each have the same inductivity LK. A capacitance CK may arise between the first and the second electrical conductors due to the dimensions of the coupler.

For a 90° hybrid, the inductivity $L_K$ and the capacitance $C_K$ may be configured as follows:

$$L_K = Z_0/(2\pi f)$$

$$C_K = 1/(2\pi f Z_0)$$

where $Z_0$ is the reference impedance and f is the frequency for which the 90° hybrid is configured.

In another aspect, this disclosure features power combiner arrangements that include the power combiners described herein, wherein the power combiner arrangements include a first high-frequency signal source connected to the first input and a second high-frequency signal source connected to the second input, and can comprise a load connected to the output.

The first high-frequency signal source and the second high-frequency signal source can be in the form of HF transistor amplifiers, e.g., frequency-agile HF transistor amplifiers. In some embodiments, the two high-frequency signal sources are identical.

The load can be in the form of a plasma system.

In other embodiments, the cooling body is connected to the equalizing connection and/or to ground, e.g., by an equalizing resistor.

Further features and advantages of the invention can be found in the following detailed description of several embodiments of the invention, in the claims, and by way of the figures of the drawings, which show details of the invention.

The features shown in the drawings are illustrated such that the distinctive features according to the invention are clearly visible. The various features can each be implemented in isolation or together in any desired combination in variants of the invention.

DETAILED DESCRIPTION

Figure 1:
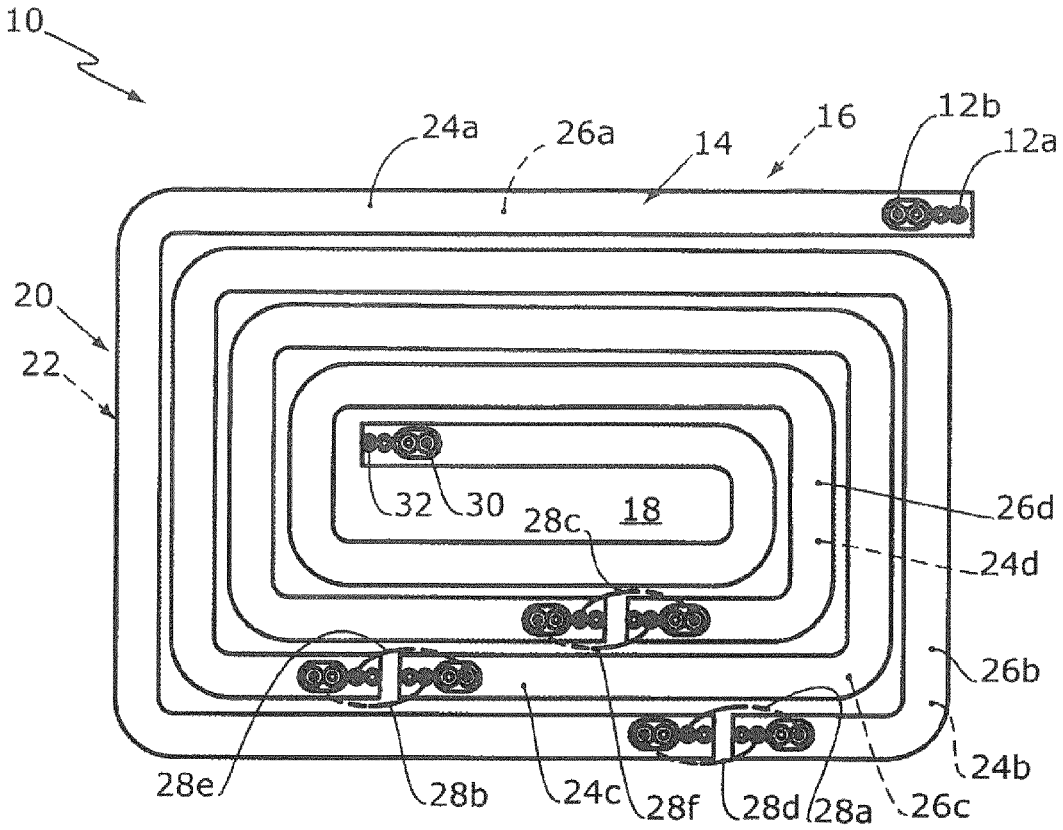
FIG. 1 is a plan view of a first power combiner.

FIG. 1 shows an example of a power combiner 10 as described herein. The power combiner 10 includes a first input 12*a* for a first high-frequency signal and a second input 32 for a second high-frequency signal.

The first input 12*a* is connected to a first electrical conductor 14. The second input 32 is connected to a second electrical conductor 16. The electrical conductors 14, 16 are inductively and capacitively coupled to one another. A dielectric, in particular an electrically insulating substrate 18, is arranged between the electrical conductors 14, 16.

More specifically, the power combiner 10 is formed by a circuit board in this case, which includes the dielectric, typically an insulating substrate 18, a first electrically conductive layer 20 arranged on a first planar main face of the dielectric or electrically insulating substrate 18, and a second electrically conductive layer 22 on a second planar main face of the electrically insulating substrate 18, and extending in parallel with the first electrically conductive layer 20.

The first electrical conductor 14 and the second electrical conductor 16 are formed in portions and alternately in the first electrically conductive layer 20 and the second electrically conductive layer 22, respectively. FIG. 1 shows only portions of the electrical conductors 14, 16 that are formed in the first electrically conductive layer 20. In FIG. 1, the second electrically conductive layer 22 is covered by the dielectric, e.g., an electrically insulating substrate 18, and by the first electrically conductive layer 20.

The first electrical conductor 14 and the second electrical conductor 16 are each largely in the form of surface electrodes. The surface electrodes each include portions that alternately extend above and below the dielectric, e.g. the electrically insulating substrate 18. Portions 24*a*, 24*c* of the first electrical conductor 14 extend in the first electrically conductive layer 20, which is visible in FIG. 1. Portions 24*b*, 24*d* of the first electrical conductor 14 extend in the second electrically conductive layer 22. Furthermore, portions 26*a*, 26*c* extend in the second electrically conductive layer 22 and portions 26*b*, 26*d* extend in the first electrically conductive layer 20. Here, the surface electrodes of the portions 24*a-d* of the first electrical conductor 14 each extend so as to be congruent and coplanar with the portions 26*a-d* of the second electrical conductor 16.

The switch from the first electrically conductive layer 20 to the second electrically conductive layer 22 takes place by bridges 28*a-f* in this example. Here, the bridges 28*a-c* guide the first electrical conductor 14 between the electrically conductive layers 20, 22 and bridges 28*d-f* guide the second electrical conductor 16 between the electrically conductive layers.

The first electrical conductor 14 ends in an output 30 at its end opposite the first input 12*a*. The second electrical conductor 16 ends in an equalizing connection 12*b* at its end opposite the second input 32.

The circuit board that is shown in FIG. 1 and is made up of the electrically conductive layers 20, 22 and the dielectric, e.g., an electrically insulating substrate 18, is arranged on a cooling body (not shown) of the power combiner 10. Due to the first and second electrical conductors 14, 16, which extend symmetrically to the dielectric, e.g., an electrically insulating substrate 18, a highly symmetrical parasitic capacitance is formed here between the first electrical conductor 14 and the cooling body, and between the second electrical conductor 16 and the cooling body. The electrical transmission properties of the power combiner 10 are only minimally affected thereby.

Figure 2:
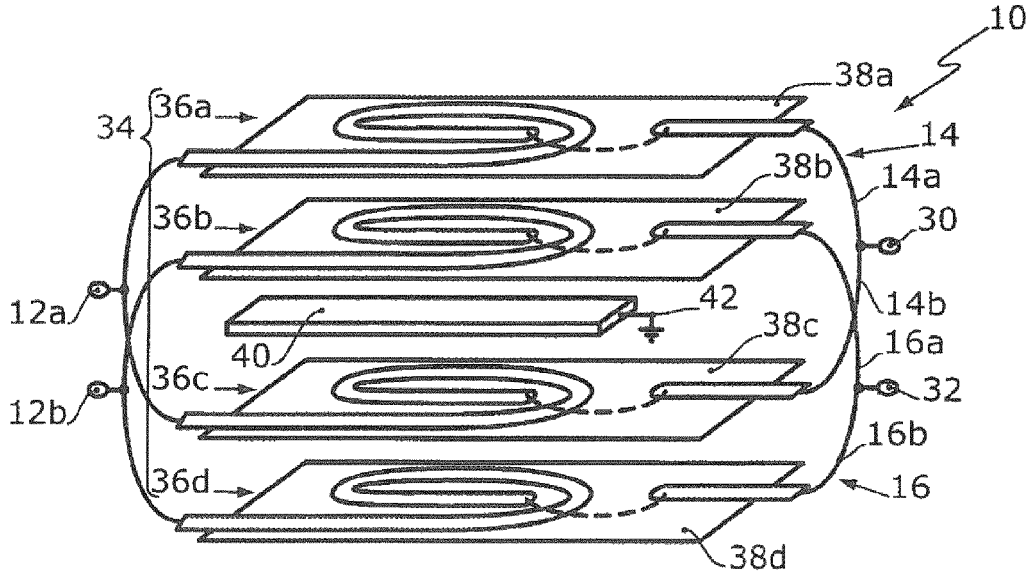
FIG. 2 is a perspective view of another power combiner.

FIG. 2 shows another power combiner 10. The power combiner 10 includes a multi-layered circuit board 34, which is composed of a plurality of circuit boards 36a-d. A first circuit board 36*a* includes a first dielectric, typically an electrically insulating substrate 38*a*, a second circuit board 36*b* includes a second dielectric, typically an electrically insulating substrate 38*b*, a third circuit board 36*c* includes a third dielectric, typically an electrically insulating substrate 38*c*, and a fourth circuit board 36*d* includes a fourth dielectric, typically an electrically insulating substrate 38*d*.

The power combiner 10 includes a first input 12*a* and a second input 32. The first input 12*a* is connected to an output 30 by a first electrical conductor 14. The second input 32 is connected to an equalizing connection 12*b* by a second electrical conductor 16.

In FIG. 2, both the first electrical conductor 14 and the second electrical conductor 16 are each split into two lines; the first electrical conductor 14 includes a first primary conductor portion 14*a* and a second primary conductor portion 14*b* and the second electrical conductor 16 includes a first secondary conductor portion 16*a* and a second secondary conductor portion 16*b*.

The power combiner 10 includes a cooling body 40, which is spaced apart symmetrically to the electrical conductors 14, 16. In this case, the second primary conductor portion 14*b* is arranged close to the cooling body 40 and the first primary conductor portion 14*a* is arranged further from the cooling body 40, while the first secondary conductor portion 16*a* is arranged close to the cooling body 40 and the second secondary conductor portion 16*b* is arranged further from the cooling body 40. The cooling body 40 is connected to ground 42.

Figure 3A:
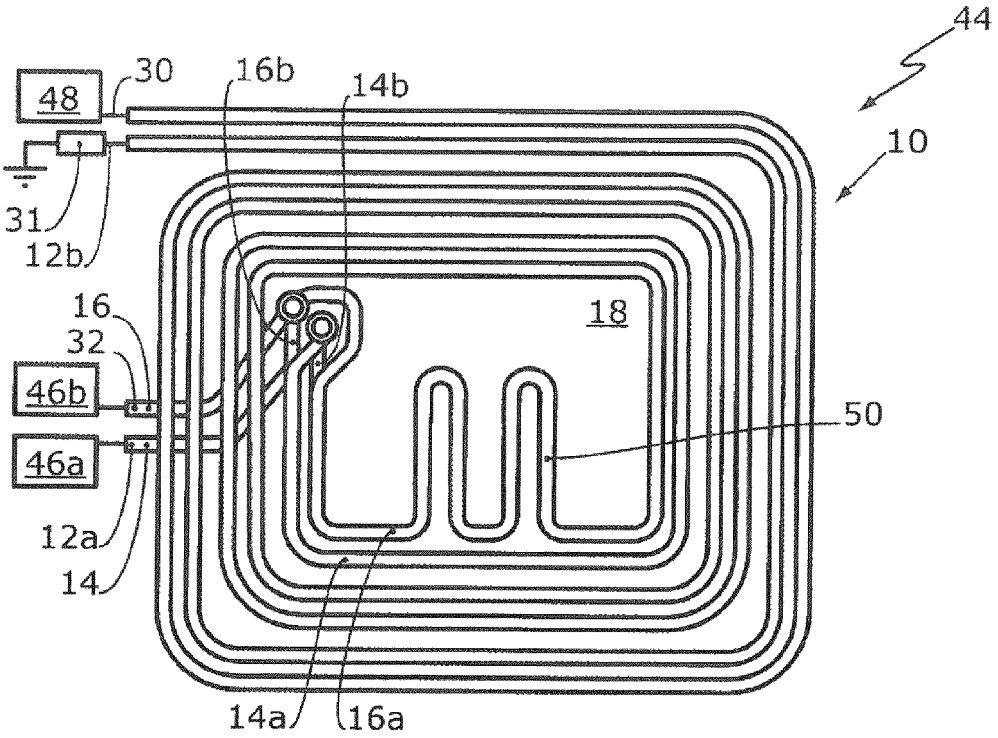
FIG. 3A is a plan view of a power combiner arrangement comprising another power combiner.

FIG. 3A shows a power combiner arrangement 44 including another power combiner 10. A first high-frequency signal source 46*a* is connected to a first input 12*a* of the power combiner 10, and a second high-frequency signal source 46*b* is connected to a second input 32 of the power combiner 10. The first input 12*a* is connected to an output 30, to which a load 48 is connected, by a first electrical conductor 14. The second input 32 is connected to an equalizing connection 12*b*, which is connected to ground potential by the terminator 31, by a second electrical conductor 16.

The power combiner 10 includes a dielectric, typically an electrically insulating substrate 18. The first electrical conductor 14 is branched into a first primary conductor portion 14*a* and a second primary conductor portion 14*b*. The second electrical conductor 16 is branched into a first secondary conductor portion 16*a* and a second secondary conductor portion 16*b*. The first primary conductor portion 14*a* and the first secondary conductor portion 16*a* are guided on a first main face of the dielectric, e.g., an insulating substrate 18. The second primary conductor portion 14*b* and the second secondary conductor portion 16*b* are guided on a second main face of the dielectric, e.g., an electrically insulating substrate 18.

The first electrical conductor 14 and the second electrical conductor 16 describe inner and outer windings, respectively. Here, the inner winding includes a path section 50 that does not extend in parallel with the outer winding, and therefore phase equalization is produced between the inner windings and the outer windings.

Bringing together the first primary conductor portion 14*a* and the second primary conductor portion 14*b* and bringing together the first secondary conductor portion 16*a* and the second secondary conductor portion 16*b* in the region of the output 30 and the equalizing connection 12*b*, respectively, takes place similarly to previous splitting in the region of reference signs 14*b*, 16*b*, and is not shown in FIG. 3A.

Figure 3B:
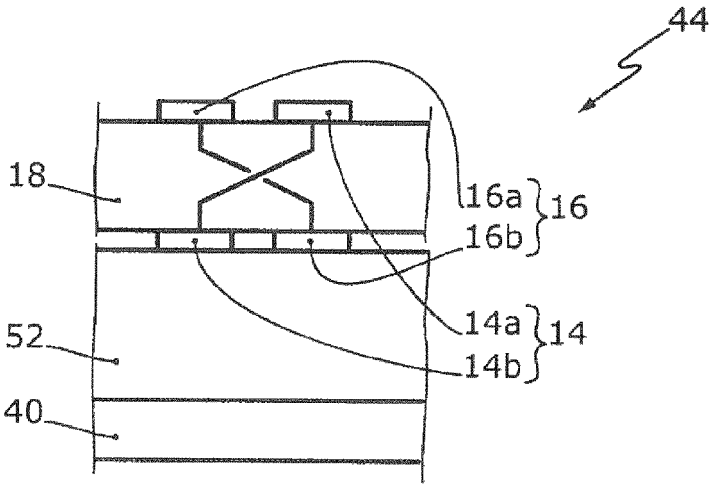
FIG. 3B is a partial sectional view of the power combiner of FIG. 3A.

FIG. 3B is a schematic partial view of the power combiner arrangement 44 of FIG. 3A. FIG. 3B shows that the second primary conductor portion 14*b* extends so as to be largely congruent with the first secondary conductor portion 16*a* and the second secondary conductor portion 16*b* extends so as to be largely congruent with the first primary conductor portion 14*a*. The dielectric, e.g., an electrically insulating substrate 18, is arranged between the conductor portions 14*a*, 16*a* and the conductor portions 14*b*, 16*b*.

The second primary conductor portion 14*b* and the second secondary conductor portion 16*b* are in contact with a dielectric, which can be designed as a thermally conductive plate 52. The thermally conductive plate 52 is placed onto a cooling body 40. The overall equidistant spacing of the electrical conductors 14, 16 from the cooling body 40 is apparent from FIG. 3B.

A dielectric of this type, which can be designed as a thermally conductive plate 52, may generally, e.g., in the arrangement of FIG. 1 or FIG. 2, be arranged between a cooling body 40 and the conductor paths or conductor path portions facing the cooling body. It can perform a number of functions. First, the dielectric is used to electrically insulate the conductor paths or conductor path portions from the potential of the cooling body 40, which is usually connected to ground. In addition, a specific capacitance between the conductor paths or conductor path portions can be set by the thickness and the dielectric properties of the dielectric. Undesired high-frequency vibrations can thus be counteracted.

In addition, electrical losses of the power combiner 10 can be adjusted by the material properties, in particular by the loss factors of the dielectric. In principle, the first assumption could be that the lowest possible losses should be optimal. In fact, for the present arrangements, in particular for loads in the form of a plasma system, it is advantageous for the power combiner 10 to have predetermined losses, to suppress resonance when high frequencies are reflected. These predetermined losses are intended to be less than 10% of the power that the power combiner 10 couples or splits. In addition, the dielectric has the advantage that the power combiner 10 can be sufficiently cooled without forced air flow solely by thermal contact with the cooling body 40.

The power combiner 10 can be installed on a common circuit board together with other components of amplifiers. This can significantly reduce the costs of amplifier/power combiner assemblies of this type, and at the same time can considerably reduce the amount of interference from external interference fields.

The power combiner 10 may be housed in a metal housing either in isolation or in combination with other components of amplifiers. This can further reduce the amount of interference from external interference fields.

A power combiner 10 includes a cooling body 40. The power combiner 10 includes at least one first electrical conductor 14 and one second electrical conductor 16. The first electrical conductor 14 and the second electrical conductor 16 are spaced so as to be largely equidistant from the cooling body 40 overall. For this purpose, the first electrical conductor 14 and the second electrical conductor 16 may be arranged alternately close to and remote from the cooling body 40. Alternatively or additionally, the cooling body 40 may be arranged between the first electrical conductor 14 and the second electrical conductor 16. Alternatively or additionally, the first electrical conductor 14 and the second electrical conductor 16 may be largely split into parallel conductor portions 14*a*, 14*b*, 16*a*, 16*b*, the conductor portions 14*a*, 14*b*, 16*a*, 16*b* spaced apart from the cooling body 40 such that the first electrical conductor 14 and the second electrical conductor 16 are largely the same distance from the cooling body 40 overall.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A power combiner for coupling, splitting, or coupling and splitting high-frequency signals, the power combiner comprising:

a first input for a first high-frequency signal;

a second input for a second high-frequency signal;

an output;

an equalizing connection;

a first electrical conductor arranged between the first input and the output, wherein the first electrical conductor has a first total surface shaped primarily as a first planar surface electrode;

a second electrical conductor arranged between the second input and the equalizing connection, wherein the second electrical conductor has a second total surface shaped primarily as a second planar surface electrode, and wherein the second electrical conductor is capacitively and inductively coupled to the first electrical conductor; and a cooling body, wherein more than 70% of the first total surface of the first electrical conductor is a same distance from the cooling body as the second total surface of the second electrical conductor, wherein the first and second electrical conductors are arranged symmetrically with respect to the cooling body such that parasitic capacitances are distributed symmetrically over the first and second conductors.

2. The power combiner of claim 1, wherein the first electrical conductor, the second electrical conductor, or both the first and second electrical conductor has an inner winding and an outer winding, and wherein the inner winding comprises a path section that does not extend in parallel with the outer winding, to produce phase equalization between the inner winding and the outer winding.

3. The power combiner of claim 1, wherein more than 60% of the first total surface of the first electrical conductor is congruent with the second total surface of the second electrical conductor.

4. The power combiner of claim 1, wherein the power combiner comprises a dielectric between the planar surface electrode of the first electrical conductor and the planar surface electrode of the second electrical conductor.

5. The power combiner of claim 4, wherein the dielectric is an electrically insulating substrate.

6. The power combiner of claim 1, wherein the first electrode and the second electrode comprise portions that alternately extend on a first planar main face of a dielectric and on a second planar main face of a dielectric opposite the first planar main face.

7. The power combiner of claim 6, wherein the dielectric is an electrically insulating substrate.

8. The power combiner of claim 1, wherein the power combiner is in the form of a 90° hybrid coupler.

9. A power combiner for coupling, splitting, or coupling and splitting high-frequency signals, the power combiner comprising:

a first input for a first high-frequency signal;

a second input for a second high-frequency signal;

an output;

an equalizing connection;

a first electrical conductor arranged between the first input and the output, wherein the first electrical conductor has a first total surface shaped primarily as a first planar surface electrode;

a second electrical conductor arranged between the second input and the equalizing connection, wherein the second electrical conductor has a second total surface shaped primarily as a second planar surface electrode, and wherein the second electrical conductor is capacitively and inductively coupled to the first electrical conductor; and a cooling body, wherein more than 70% of the first total surface of the first electrical conductor is a same distance from the cooling body as the second total surface of the second electrical conductor, wherein more than 60% of the first total surface of the first electrical conductor is congruent with the second total surface of the second electrical conductor, and wherein more than 60% of the first total surface of the first electrical conductor is coplanar with the second total surface of the second electrical conductor.

10. The power combiner of claim 9, wherein the first electrical conductor comprises a first primary conductor portion and a second primary conductor portion and the second electrical conductor comprises a first secondary conductor portion and a second secondary conductor portion, and more than 70% of the second secondary conductor portion extends offset from the first primary conductor portion and is coplanar and congruent with the first primary conductor portion, and more than 70% of the second primary conductor portion is coplanar and congruent with the first secondary conductor portion.

11. The power combiner of claim 10, wherein the cooling body is arranged between the first secondary conductor portion and the second primary conductor portion.

12. A power combiner for coupling, splitting, or coupling and splitting high-frequency signals, the power combiner comprising:

a first input for a first high-frequency signal;

a second input for a second high-frequency signal;

an output;

an equalizing connection;

a first electrical conductor arranged between the first input and the output, wherein the first electrical conductor has a first total surface shaped primarily as a first planar surface electrode;

a second electrical conductor arranged between the second input and the equalizing connection, wherein the second electrical conductor has a second total surface shaped primarily as a second planar surface electrode, and wherein the second electrical conductor is capacitively and inductively coupled to the first electrical conductor; and a cooling body, wherein more than 70% of the first total surface of the first electrical conductor is a same distance from the cooling body as the second total surface of the second electrical conductor, wherein the power combiner is configured to have a reference impedance of less than 50 Ω at a frequency of more than 1 MHz at the first input and at the second input.

13. The power combiner of claim 12, wherein the power combiner is configured to have a reference impedance of less than 25 Ω at a frequency of more than 1 MHz at the first input and at the second input.

14. A power combiner for coupling, splitting, or coupling and splitting high-frequency signals, the power combiner comprising:

a first input for a first high-frequency signal;

a second input for a second high-frequency signal;

an output;

an equalizing connection;

a first electrical conductor arranged between the first input and the output, wherein the first electrical conductor has a first total surface shaped primarily as a first planar surface electrode;

a second electrical conductor arranged between the second input and the equalizing connection, wherein the second electrical conductor has a second total surface shaped primarily as a second planar surface electrode, and wherein the second electrical conductor is capacitively and inductively coupled to the first electrical conductor; and a cooling body, wherein more than 70% of the first total surface of the first electrical conductor is a same distance from the cooling body as the second total surface of the second electrical conductor, wherein the first electrical conductor and the second electrical conductor each have a number of windings greater than 1.

15. A power combiner for coupling, splitting, or coupling and splitting high-frequency signals, the power combiner comprising:

a first input for a first high-frequency signal;

a second input for a second high-frequency signal;

an output;

an equalizing connection;

a first electrical conductor arranged between the first input and the output, wherein the first electrical conductor has a first total surface shaped primarily as a first planar surface electrode;

a second electrical conductor arranged between the second input and the equalizing connection, wherein the second electrical conductor has a second total surface shaped primarily as a second planar surface electrode, and wherein the second electrical conductor is capacitively and inductively coupled to the first electrical conductor; and a cooling body, wherein more than 70% of the first total surface of the first electrical conductor is a same distance from the cooling body as the second total surface of the second electrical conductor, wherein the power combiner is configured to produce an output power of more than 100 W and have a frequency of more than 1 MHz.

16. The power combiner of claim 15, wherein the power combiner is configured for coupling high-frequency signals of between 1 MHz and 200 MHz.

17. The power combiner of claim, 15, wherein the power combiner is configured for outputting power of over 2 kW.

18. A power combiner arrangement comprising:

a power combiner comprising:

a first input for a first high-frequency signal;

a second input for a second high-frequency signal;

an output;

an equalizing connection;

a first electrical conductor arranged between the first input and the output, wherein the first electrical conductor has a first total surface shaped primarily as a first planar surface electrode;

a second electrical conductor arranged between the second input and the equalizing connection, wherein the second electrical conductor has a second total surface shaped primarily as a second planar surface electrode, and wherein the second electrical conductor is capacitively and inductively coupled to the first electrical conductor; and a cooling body, wherein more than 70% of the first total surface of the first electrical conductor is a same distance from the cooling body as the second total surface of the second electrical conductor, a first high-frequency signal source connected to the first input;

a second high-frequency signal source connected to the second input; and a load connected to the output, wherein the first and second electrical conductors are arranged symmetrically with respect to the cooling body such that parasitic capacitances are distributed symmetrically over the first and second conductors.

* * * * *